US006077056A

United States Patent [19]

Gmelin

[11] Patent Number: 6,077,056

[45] Date of Patent: Jun. 20, 2000

[54] RECIPROCATING PUMP

[75] Inventor: Karl Gmelin, Flein, Germany

[73] Assignee: Robert Bosch GmbH, Stuttgart, Germany

[21] Appl. No.: 09/040,262

[22] Filed: Feb. 12, 1998

[30] Foreign Application Priority Data

Feb. 12, 1997 [DE] Germany ..... 197 05 205

[51] Int. Cl.[7] ..... F04B 1/053; F04B 9/04

[52] U.S. Cl. ..... 417/547; 417/273; 92/156; 92/158

[58] Field of Search ..... 417/273, 547; 92/157, 153, 156, 158, 159

[56] References Cited

U.S. PATENT DOCUMENTS 5,626,466 5/1997 Ruoff .

FOREIGN PATENT DOCUMENTS

| | | |
|---|---|---|
| 2909248C2 | 9/1980 | Germany . |
| 3522479A1 | 6/1985 | Germany . |
| 3726957C2 | 3/1989 | Germany . |
| 4419927A1 | 6/1994 | Germany . |
| 19523283A1 | 1/1997 | Germany . |
| 2160596 | 6/1985 | United Kingdom . |

OTHER PUBLICATIONS

Fluidtechnik von A Bis Z, by H. Ebertshauser, Vereinigte Fachverlage.Krausskopf/Ingenieur–Digest Radialkolbenpumpe pp. 259–260.

Bosch–Hydraulik Informationen und Daten 1970/71; Hydraulik Bosch; Gerate–Funktionsbeschreibung, Pumpen und Motoren; pp. 57 & 64.

Hydraulik in Theorie und Praxis Von Bosch.; Bosch–Hydraulik, Axialkolbenpumpen und–motoren; pp. 59–64, ©1983 Robert Bosch GmbH.

*Primary Examiner*—Andrew M. Dolinar

*Attorney, Agent, or Firm*—Ronald E. Greigg; Edwin E. Greigg

[57] ABSTRACT

The invention relates to a high pressure reciprocating pump, for a fuel injection system of an internal combustion engine, having at least one piston, which is displaceably supported in a piston guide provided in a housing and therein defines a work chamber. Supported in the housing is a drive shaft, on which a crank element is provided on which a stroke ring, is not rotatable in the housing. The crank element is rotatably supported, the stroke ring has a slide bearing face, associated with the piston on which face the piston is supported with a slide face, so that the piston can be acted upon by the drive shaft. To reduce the danger of so-called seizing of the bearing faces moving back and forth on one another when poorly lubricating media such as fuel and in particular gasoline are being pumped, it is provided that a relief chamber, formed by a recess in the slide face disposed on the piston and open toward the slide bearing face on the stroke ring, communicates with the work chamber.

15 Claims, 4 Drawing Sheets

Fig. 2a
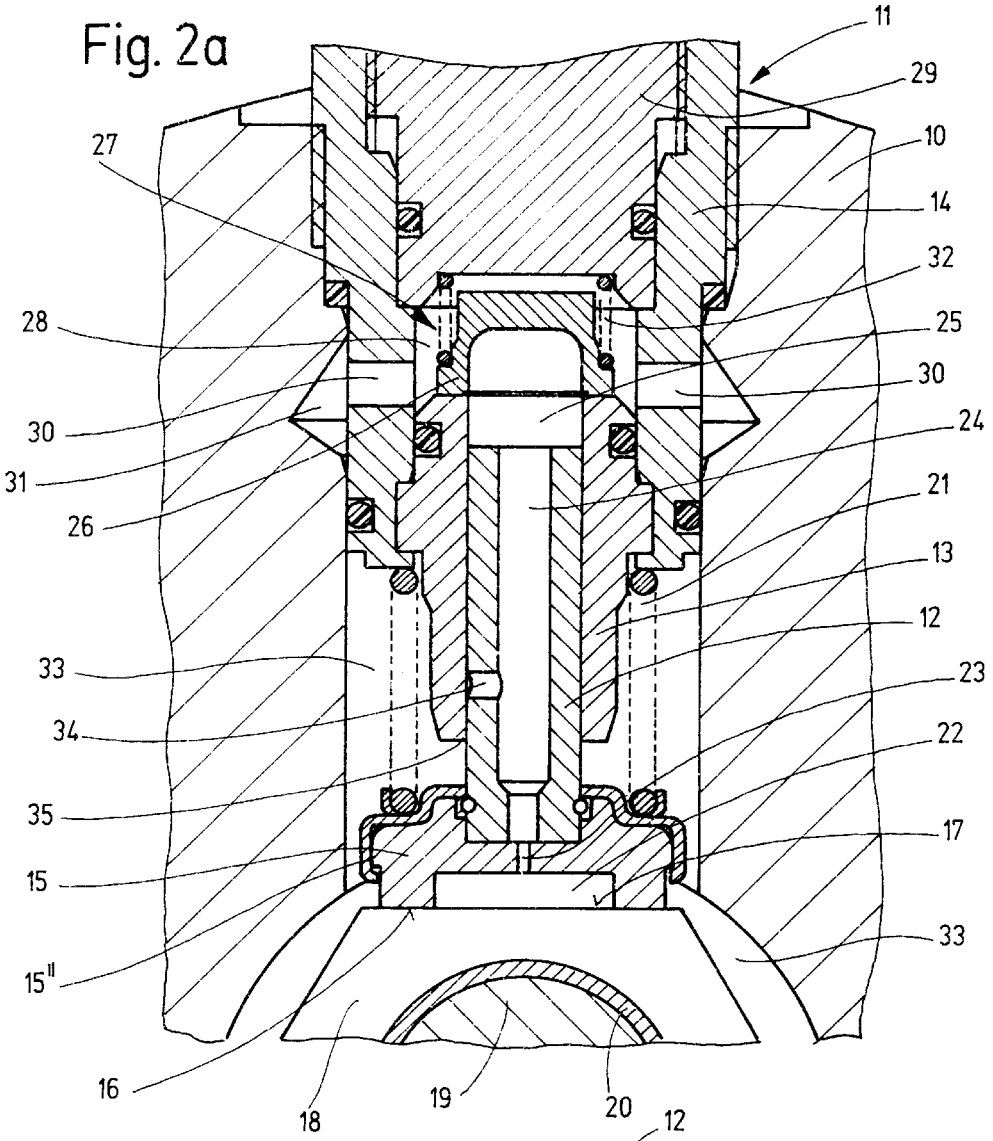
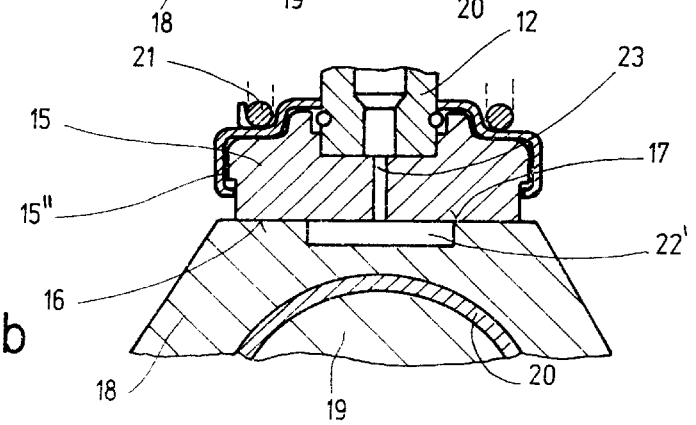
Fig. 2b

RECIPROCATING PUMP

FIELD OF THE INVENTION

The invention relates to a reciprocating pump, in particular a high-pressure pump for a fuel injection system of an internal combustion engine.

BACKGROUND OF THE INVENTION

In such a reciprocating pump (German Patent Application DE 35 22 479 A1), a plurality of pistons arranged in a star configuration are driven by means of an eccentric provided on a drive shaft. A bush that is nonrotatable in the pump housing is supported as a stroke ring on the eccentric and on its outer circumferential face has one bearing face for each piston, on which face a slide cushion rests. On this slide cushion, the piston is supported with a steel disk mounted on its corresponding end.

In this known pump, the delivery and withdrawal of the medium to be pumped to and from the work chamber are effected through the same line, using control valves; the piston is held in contact with the stroke ring by the delivered medium to be pumped.

In this reciprocating pump, instead of the steel disk it is also possible for a tappet to be inserted into a recess in the piston that is open toward the stroke ring. The tappet then rests with a flange on the slide cushion and is pressed against the stroke ring by a compression spring disposed in the tappet interior. The tappet thus remains in contact with the stroke ring even if the delivery of medium to be pumped is interrupted, and thus prevents an undesired rotation of the stroke ring relative to the housing.

To attain a shock absorbing effect, the tappet is provided with a supply connection and an axial bore, through which oil can be delivered to the interior of the tappet and piston.

"Hydraulik in Theorie und Praxis. von Bosch." [Hydraulics in Theory and Practice, by Bosch], by W. Götz, 1983, published by Robert Bosch GmbH, Stuttgart, discloses a radial reciprocating pump with external piston support, in which a cylinder star is driven by a drive shaft. The cylinder star has a plurality of cylinders in which radially displaceable pistons are disposed, and the pistons are supported radially on the outside via sliding blocks on the inside circumference of a stroke ring that is disposed essentially in a manner fixed against relative rotation and eccentrically to the cylinder star in the leakage chamber of the pump. The pistons are held in contact with the stroke ring by the medium to be pumped.

In order to achieve a hydrostatic bearing relief of the slide bearings formed by the stroke ring and the sliding blocks, each sliding block, in the middle of its slide face, has a recess that communicates with the respective cylinder chamber. In operation of this known pump, the sliding blocks always move in the same direction along the inside circumferential surface of the stroke ring.

"Bosch-Hydraulik: Informationen und Daten 1970/71" [Bosch Hydraulics, Information and Data, 1970–71], p. 57, an axial reciprocating pump of the oblique disk type is known, in which the axial pistons are disposed in corresponding bores of a pump body that is driven by a drive shaft. The pistons are supported via sliding blocks on the working face of an oblique disk provided in the leakage chamber of the pump, and the sliding blocks are held in contact with the oblique disk by a holding-down ring.

To achieve hydrostatic bearing relief of the slide bearings formed by the oblique disk and the sliding blocks, a recess in the middle of the slide face of the sliding blocks communicates with the respective work chamber. In this known pump as well, during operation the sliding blocks always move in the same direction along the working surface of the oblique disk.

Another known radial reciprocating pump (German Patent DE 37 26 957 C2) has pistons, which are guided in cylinders disposed on the housing. The pistons are driven by a drive shaft via an eccentric. For supporting the pistons on the jacket face of the eccentrics, a sliding block is mounted on the piston, and a recess is provided in its support face that rests on the jacket face of the eccentric; the recess communicates with the respective associated work chamber, for the sake of hydrostatic bearing relief. The effective area of the recess serving the purpose of bearing relief is less than the effective piston area. In this known pump as well, the sliding blocks always move in the same direction relative to the support bearing face on the eccentric.

OBJECT AND SUMMARY OF THE INVENTION

The reciprocating pump has the advantage over the prior art that because of the communication of the relief chamber with the work chamber, a hydrostatic relief of the slide bearing between the piston and the stroke ring can be achieved such that even in a bearing whose slide faces execute an oscillating motion relative to one another, the risk of so-called seizing can be reduced substantially, so that the pump can be used in that case especially even to pump poorly lubricating media, such as fuel and especially gasoline, even if very high pressures must be furnished on the outlet side. Because of the hydrostatic relief of the slide bearings, there is also a substantial reduction in friction, and thus the pump drive capacity can be lowered.

The reduction in friction leads to a reduction in a tilting moment acting on the piston, which must be absorbed by the guide face of the piston in the housing, and thus leads to reduced wear of the piston guide. This increases the service life of the reciprocating pump of the invention.

According to the invention, a hydrostatic relief of faces sliding on one another is accordingly provided, in a reciprocating pump in which a rotary drive motion of a drive shaft is not converted directly into a linear motion of a piston but rather is first converted into a nonrotating revolutional motion of a stroke ring that drives the pistons. The result is a split support or bearing of the piston on the drive shaft. This support includes the slide bearing that is formed by the slide face on the piston and by the slide bearing face on the stroke ring and that absorbs an oscillating linear motion and is hydrostatically relieved according to the invention; the support also includes the bearing of the stroke ring on the drive shaft, or on the crank element disposed on the drive shaft, that enables the rotation of the stroke ring relative to the drive shaft.

It is especially advantageous if the contact-pressure force between the slide face associated with the piston and the slide bearing face on the stroke ring is made independent of the feed pressure generated during the pumping stroke, which is done by means of suitable dimensioning of the effective area of the relief chamber in proportion to the effective piston area.

If a spring is used in order to press the piston against the stroke ring, especially during the intake stroke of the piston, or in other words to assure a positive pressure per unit of surface area between the slide face and the slide bearing face at all times, then the contact-pressure-force can be limited substantially to the spring force or can even be made less than the spring force.

Moreover, in the gap between the slide face associated with the piston and the slide bearing face on the stroke ring, and, if the piston is supported via a support face pairing on a sliding block, then in the gap between these support faces as well, especially during the pumping stroke, because of the pressure drop between the work chamber and the relief chamber on the one hand and the low-pressure chamber on the other, slide films develop, which further reduce the friction. Because of this reduction of friction, it is possible especially in the pumping stroke to further reduce tilting of the piston relative to the piston guide, since the stroke ring, which during pump operation executes an oscillating motion perpendicular to the piston axis, is hardly capable of transmitting transverse forces to the piston.

Further advantageous features of and improvements to the reciprocating pump recited in the main claim are possible with the provisions recited in the dependent claims.

The invention will be better understood and further objects and advantages thereof will become more apparent from the ensuing detailed description of preferred embodiments taken in conjunction with the drawings.

BRIEF DESCRIPTION OF THE DRAWINGS

FIG. 2*a* is a section through a pump element of the reciprocating pump of FIG. 1;

FIG. 2*b* is a section through a region in which a sliding block rests on a stroke ring, in a reciprocating pump of FIG. 1;

DESCRIPTION OF THE PREFERRED EMBODIMENTS

Figure 1:
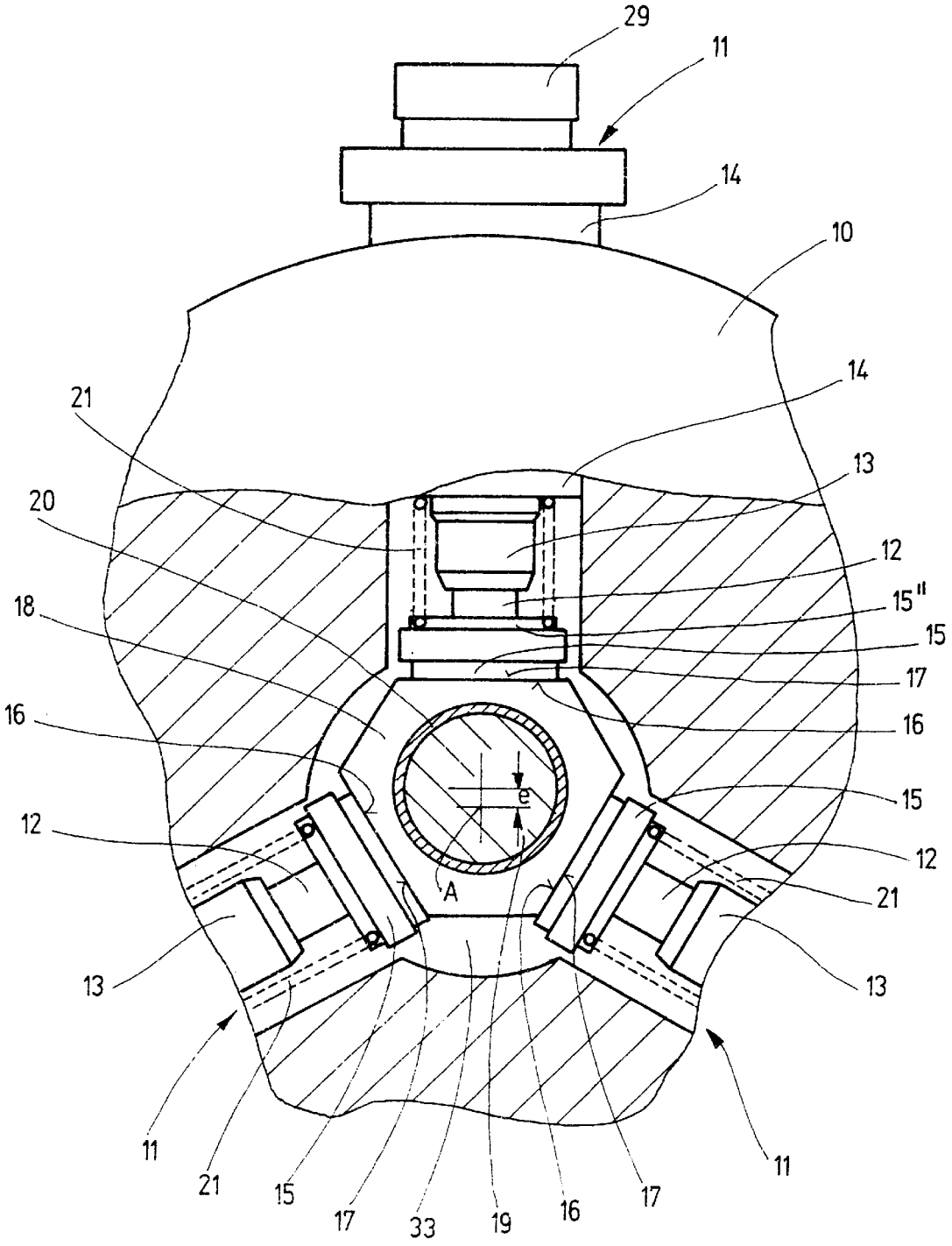
FIG. 1, in a partly sectional view in the plane of pistons arranged in a star, shows a reciprocating pump according to the invention.

In the various drawing figures, parts corresponding with one another are identified by the same reference numerals.

As FIG. 1 shows, a reciprocating pump according to the invention has a housing 10, in which three pump elements 11, for instance, are arranged in a star configuration. Depending on the desired uniformity of the pressure generated by the reciprocating pump, it is also possible for more or fewer pump elements 11 to be provided.

Each pump element 11 includes a piston 12, which is displaceably supported in a piston guide 13. The piston guide 13 is retained in the housing 10 by a retaining part 14. Although in the exemplary embodiments shown in the drawings the piston guide 13 is shown as a separate component, it is also possible for the guidance for the piston 12 to be embodied directly in the housing 10.

Each piston 12, on its end protruding out of the piston guide 13, has a sliding block 15 with a slide face 16, by way of which the piston 12 is supported on a slide bearing face 17 on a stroke ring 18 that is rotatably supported on a crank element 19, such as an eccentric protrusion, of a drive shaft. A bearing means, such as a slide bearing 20, is expediently provided between the stroke ring 18 and the crank element 19.

In order for the piston 12, with the slide face 16 associated with it, to be held constantly in contact with the stroke ring 18 during operation of the reciprocating pump, each piston 12 is assigned a spring 21, which is braced by one end on the retaining part 14 and by the other, via a clamp 15" that holds the sliding block 15 on the piston 12, on the slide block 15, and which presses the sliding block 15 and thus the piston 12 as well away from the retaining part 14 toward the stroke ring 18.

Since the crank element 19 is disposed with an eccentricity e relative to the drive shaft axis A, each of the pistons 12 is driven to execute a reciprocating motion in the piston guide 13, the stroke of which is twice the eccentricity e, or in other words whose stroke amounts to 2*e*. The stroke ring 18 is displaced back and forth parallel to the corresponding slide bearing face 17 and perpendicular to the drive shaft axis A by the amount 2*e* relative to the corresponding piston 12.

In order particularly in the pumping stroke of the piston 12, or in other words when the piston 12 as shown in FIG. 2*a* is pressed upward into the piston guide 13, to reduce the contact-pressure force with which the sliding block 15 is pressed against the stroke ring 18, a relief chamber 22 that is open to the slide bearing face 17 on the stroke ring 18 is provided in the sliding block 15; via a through opening 23 in the sliding block 15 and an axial conduit 24, this chamber communicates with a work chamber 25 of the pump element 11.

As suggested in FIG. 2*b*, it is also possible, instead of or in addition to the relief chamber 22 in the sliding block 15, to provide a recess in the slide bearing face 17 on the stroke ring 18, so as to form a relief chamber 22' in the stroke ring 18.

The work chamber 25 in the piston guide 13 is defined on one side by the piston 12 and on the other by a valve body 26 of a pressure valve 27 that divides the work chamber 25 from a high-pressure chamber 28, which is provided between the piston guide 13 and a closure part 29 in the retaining part 14 that is inserted into the retaining part 14.

The high-pressure chamber 28 communicates, via radial through bores 30, with an inlet region 31 of a pressure line, not shown, that leads to a high-pressure connection. The closure part 29 serves here as an abutment for a valve spring 32, which presses the valve body 26 against the piston guide 13.

To enable delivering a medium, especially fuel or gasoline, that is preferably under pilot pressure and to be pumped out of a low-pressure chamber 33, provided in the housing 10, to the work chamber 25, in the exemplary embodiment of the invention shown in FIG. 2*a* a suction valve is provided in a wall of the piston 12; it includes a radial suction opening 34 in the piston 12 that connects the conduit 24 with the outside of the piston 12. The suction opening 34 is disposed such that it is opened and closed by an edge 35 of the piston guide 13 that acts as a control edge.

When the reciprocating pump of the invention is in operation, once the suction opening 34 has been closed by the piston guide 13, as shown in FIG. 2*a*, then during the pumping stroke, or in other words while the piston 12 is being moved upward as in FIG. 2*a*, the pressure of the medium enclosed in the work chamber 25, the conduit 24 and the relief chamber 22 or 22' is increased until such time as the force exerted on the valve body 26 of the pressure valve 27 by the pumped medium under pressure in the work chamber 25 is greater than the closing force acting on the valve body 26, which latter force is composed of the force of the valve spring 32 and the compressive force exerted by the pumped medium in the high-pressure chamber 28 on the valve body 26.

During the pumping stroke, the sliding block 15 is pressed against the stroke ring 18 by the spring 21 and the pressure prevailing in the work chamber 25, while the pressure exerted by the medium in the relief chamber 22 or 22' on the sliding block 15 generates a force pointing away from the stroke ring 18. If the effective area of the relief chamber 22 or 22' is greater than the effective area of the piston 12, then the force exerted by the piston 12 on the sliding block 15 is fully compensated for, and the force generated by the spring 21 is partly compensated for. In the dimensioning of the effective area of the relief chamber 22 or 22', it should be taken into account that the force generated by the spring 21 must not be compensated for completely, since a positive pressure per unit of surface area must always be present between the slide face 16 on the sliding block 15 and the slide bearing face 17 on the stroke ring 18, so as to largely seal off the relief chamber 22 in order that the desired high pumping pressure will be achieved.

The piston 12, sliding block 15 and stroke ring 18 are located inside the low-pressure chamber 33. During the entire stroke of the piston 12, the slide face 16 of the sliding block 15 rests on the slide bearing face 17 of the stroke ring 18. Upon a rotary motion of the crank element 19, the stroke ring 18 is displaced, because of the eccentricity e (FIG. 1), along the slide face 16 of the sliding block 16. In terms of the direction of this relative motion, the length of the slide bearing face 17 of the stroke ring 18 is dimensioned adequately enough that the relief chamber 22 cannot protrude past the end of the slide bearing face 17 (FIG. 2*a*), or the length of the slide face 16 of the sliding block 15 is dimensioned adequately enough that the relief chamber 22' cannot protrude past the end of the slide face 16 (FIG. 2*b*). It is thus assured that the medium under pressure in the work chamber 25 cannot flow unintentionally out of the relief chamber 22 or 22' into the low-pressure chamber 33 during a pumping stroke.

The relief chamber 22 and/or 22', the slide face 16, and the slide bearing face 17 are accordingly dimensioned such that the relief chamber 22 or 22' is closed off from the low-pressure chamber 33 in every position of the stroke ring 18. During a pumping stroke, the relief chamber 22 or 22' is enclosed by the contact between the slide face 16 and the slide bearing face 17 in every position of the stroke ring 18.

As soon as the pressure in the work chamber 25, the conduit 24 and the relief chamber 22, at the end of the pumping stroke, after the pressure valve 27 opens, has dropped below a pressure that effects the closure of the pressure valve 27 and the piston 12 begins to execute its intake stroke, or in other words to move downward as shown in FIG. 2*a*, a negative pressure arises in the work chamber 25, conduit 24 and relief chamber 22, since at that moment the suction opening 34 is still closed by the piston guide 13. Hence no substantial force acts counter to the spring 21, and the piston 12 is moved out of the piston guide 13. As soon as the suction opening 34 reaches the edge 35 of the piston guide 13 and is thus opened, fuel is aspirated out of the low-pressure chamber 33 through the suction opening 34 and the conduit 24 into the work chamber 25 and the relief chamber 22, and a pressure equilibrium is essentially established between the low-pressure chamber 33, the work chamber 25, and the relief chamber 22.

As long as the suction opening 34 is open during the remaining intake stroke and is not yet fully closed during the ensuing pumping stroke, substantially the same pressure prevails in the work chamber 25, in the conduit 24, in the relief chamber 22, and in the low-pressure chamber 33.

It is indeed conceivable for the effective area of the relief chamber 22 to be selected as less than the effective area of the piston 12, so that on the one hand, the contact-pressure force between the sliding block 15 and the stroke ring 18, generated by the piston 12 during the pumping stroke, is compensated for only partially, but on the other, the sealing off of the relief chamber 22 or 22' from the low-pressure chamber 33 is improved because the pressure per unit of surface area between the slide face 16 and the slide bearing face 17 increases as the pressure in the work chamber 25 increases. It is preferable for the effective area of the relief chamber 22 and 22' to be selected as at least equal to or greater than the effective area of the piston 12. In the first case, the contact-pressure force for the sliding block 15 is thus furnished solely by the spring 21. In the second case, conversely, as the pressure in the work chamber 25 and in the relief chamber 22 or 22' rises, some of the spring force that increases in the pumping stroke is compensated for. The effective area of the relief chamber 22 or 22', however, must be made only just large enough that the force urging the sliding block 15 in the direction away from the stroke ring 18 is no greater than or is equal to the sum of the spring force of the spring 21 and the force exerted on the piston 12 by the pressure in the work chamber 25.

Since in the reciprocating pump of the invention the medium to be pumped is for instance pumped at a pilot pressure of approximately 3 bar into the low-pressure chamber 33, while the output pressure of the reciprocating pump is between 60 and 120 bar or more, a substantial reduction in the pressure per unit of surface area is brought about between the sliding block 15 and the stroke ring 18, or in other words between the slide face 16 and the slide bearing face 17, which is advantageous especially given the poor lubricating action of fuels, and particularly gasoline.

Since the sliding block 15 is pressed against the stroke ring 18 then upon a displacement of the slide bearing face 17 of the stroke ring 18 along the slide face 16 of the sliding block 15 a frictional force occurs which acts crosswise to the longitudinal axis of the piston 12 upon the piston 12 via the sliding block 15. The reduction in the pressure per unit of surface area brought about by the pressure in the relief chamber 22 or 22' has the result, even in the case of poorly lubricating media, of reducing the: friction between the sliding block 15 and the stroke ring 18, so that even a force exerted upon the piston 12 crosswise to its longitudinal axis by the stroke ring 18 as a consequence of friction, and which force results in a tilting moment acting upon the piston 12, is markedly reduced. As a result, the service life of the pump of the invention can be increased, since the area of the piston guide 13 that guides the piston 12, and that must support the tilting forces or tilting moment, is subject to reduced wear.

Figure 3:
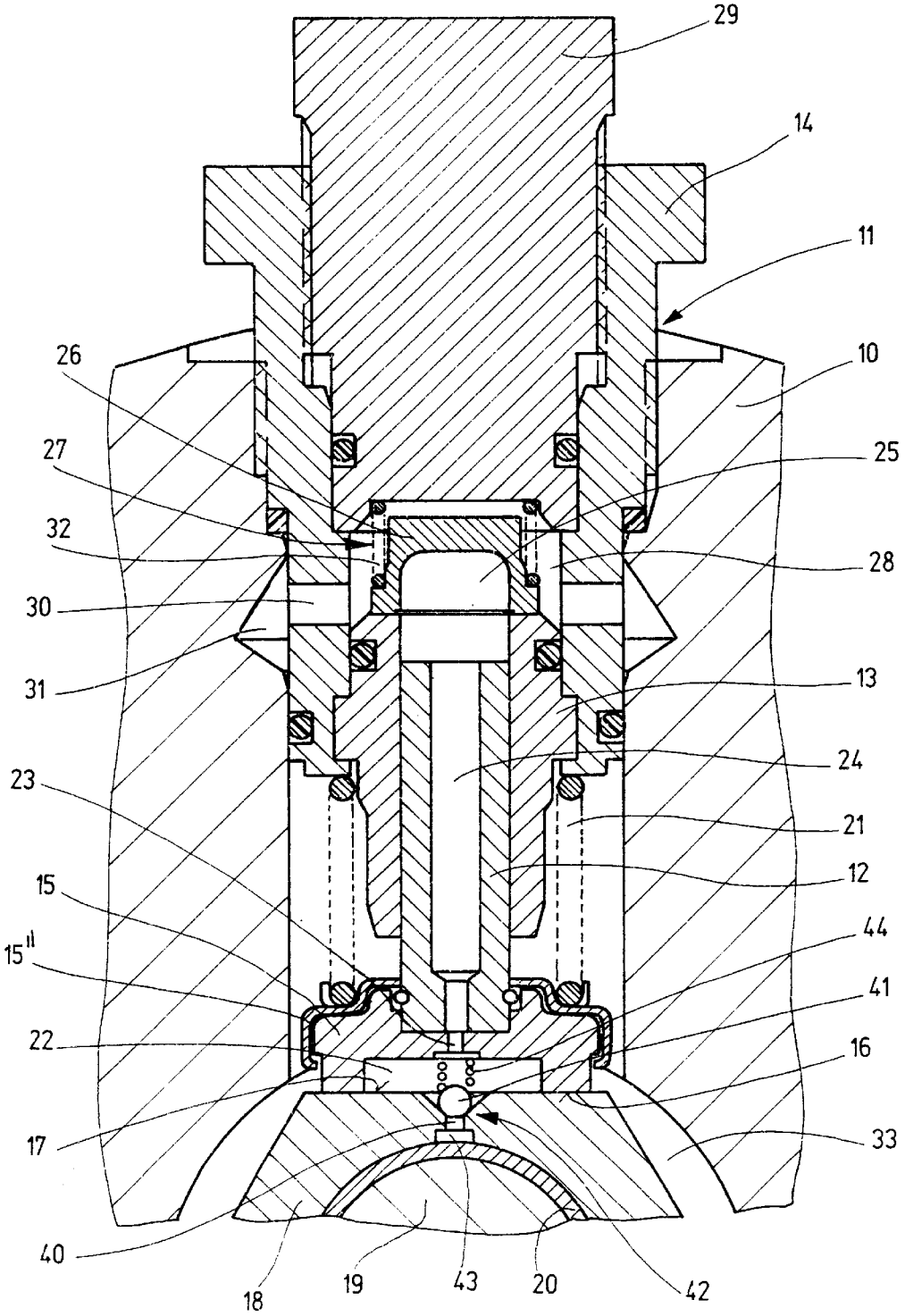
FIG. 3 is a section through a pump element of another reciprocating pump according to the invention.

FIG. 3 shows another exemplary embodiment of the reciprocating pump of the invention, which differs from the embodiment shown in FIG. 2*a* in terms of the disposition of the aspiration path between the low-pressure chamber 33 and the work chamber 25.

The stroke ring 18 has one radial suction bore 40 in a region of each of its slide bearing faces 17, and this bore is widened in funnel fashion toward the slide bearing face 17 in order to form a receptacle for what is for instance a spherical valve body 41 of a suction valve 42. On the radially inner end, that is, its end toward the slide bearing 20, the suction bore 40 discharges into a suction groove 43, which communicates with the low-pressure chamber 33 and is provided, extending substantially axially, in the inner bearing face of the stroke ring that cooperates with the slide bearing 20. A valve spring 44 disposed in the relief chamber 22 is supported between the sliding block 15 and the valve body 41 of the suction valve 42, so as to press the valve body 41 into its seat.

It is also conceivable, instead of the supporting of the valve spring 44 on the sliding block 15 as shown, to provide a spring holder or support bracket on the stroke ring that does not hinder the flow course through the suction valve 42, so that the valve spring 44 is held solely on the stroke ring 18, and thus is not deformed by the displacement motion between the sliding block 15 and the stroke ring 18.

In operation of the reciprocating pump of the invention described in conjunction with FIG. 3, the suction valve 42 closes, after the completion of the intake stroke of the piston 12 at the beginning of the pumping stroke, with reinforcement from the valve spring 44. While the piston 12, during the pumping stroke, is being displaced toward the work chamber 25, the pressure in the work chamber 25 and in the relief chamber 22 rises up to the moment when the pressure valve 27 opens. As a result, if the effective area of the relief chamber 22 is greater than the effective area of the piston 12, the contact-pressure force acting upon the sliding block 15 can be kept constant or can be reduced, in that the increase in spring force effected by the compression of the spring 21 is compensated for, or overcompensated for. Thus the friction between the sliding block 15 and the stroke ring 18 during the pumping stroke can also be kept constant or reduced.

As soon as the intake stroke begins, the suction valve 42 opens, and medium to be pumped is aspirated out of the low-pressure chamber 33 into the work chamber 25, through the suction groove 43, suction bore 40, suction valve 42, relief chamber 22, through opening 23 in the sliding block 15, and conduit 24 in the piston 12. As a result, even at the onset of the intake stroke, a pressure equilibrium is essentially achieved, so that the pressure in the work chamber 25 and in the relief chamber 22 is only slightly less than the pressure in the low-pressure chamber 33. Accordingly, the contact-pressure force is generated by the spring 21.

Figure 4:
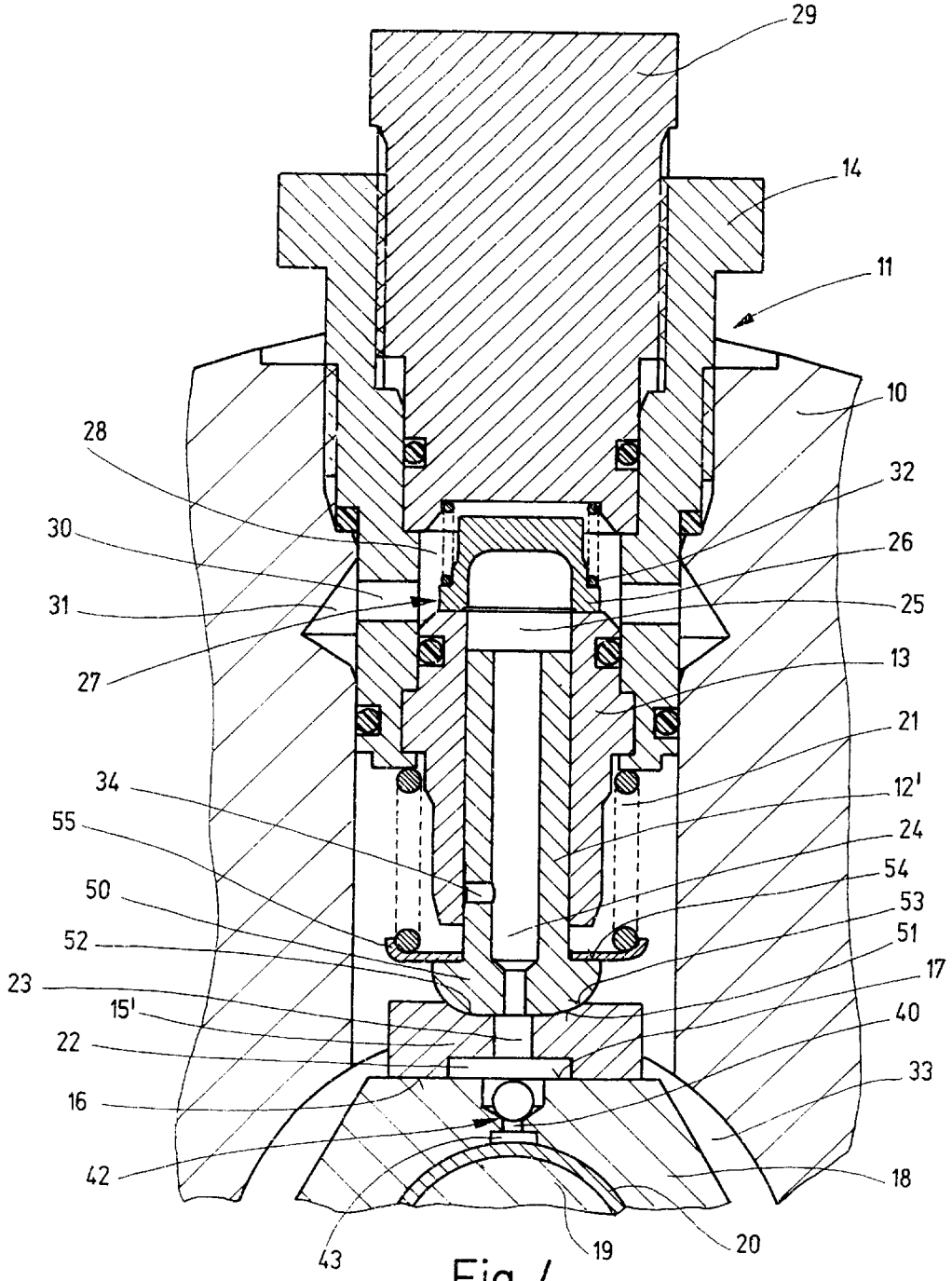
FIG. 4 is a section through a pump element of a further reciprocating pump of the invention.

In another exemplary embodiment of the reciprocating pump of the invention, as shown in FIG. 4, both a suction opening 34 in the piston 12 and a suction valve 42 in the stroke ring 18, between a suction groove 43 and the relief chamber 22, are provided.

In addition, the piston 12' has an end portion of crowned shape or in the form of a portion of a sphere, which by way of a conical support face 51 is braced in a complementary recess 52 in the sliding block 15' on a corresponding support face 53. On its side remote from the sliding block 15', the end portion 50 of the piston 12' is provided with a shoulder 54, on which an abutment ring 55 for the spring 21 rests.

This supporting of the piston 12' on the sliding block 15' can also be provided in the exemplary embodiments of FIGS. 2*a*, 2*b* and 3. The fastening of the sliding block 15 to the piston 12 shown there can also be employed in the embodiment of the invention shown in FIG. 4.

In the reciprocating pump of the invention shown in FIG. 4, the hydrostatic relief of the sliding block 15' is effected during the pumping stroke in the same way as in the embodiment of FIG. 2*a*. At the onset of the intake stroke, the reciprocating pump of FIG. 4 functions essentially like that shown in FIG. 3. After the uncovering of the suction opening 34 in the piston 12', then once again substantially the same conditions prevail as in the embodiment of FIG. 2*a*.

Since the aspiration of medium to be pumped, after the opening of the suction opening 34, is effected both through the suction opening 34 and through the suction bore 40 in the stroke ring 18, the flow cross sections of the suction bore 40 and the suction groove 43 can be embodied as smaller, compared with the embodiment of FIG. 2*a* or FIG. 3.

Because the piston 12' is supported with its crowned or spherical end portion 50, possible tilting motions of the piston 12' in the piston guide 13, which can be caused by production variations, can be compensated for. The gap between the support faces 51 and 53 on the piston 12' and sliding block 15', respectively, is relieved during the pumping stroke by a film of medium to be pumped, since as a consequence of the high pressure in the conduit 24 and in the relief chamber 22, medium to be pumped is forced through this gap into the low-pressure chamber 33.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A high-pressure reciprocating pump for a fuel injection system of an internal combustion engine, comprising;

at least one piston, which is displaceably supported in a housing and defines a work chamber therein, a drive shaft, supported in the housing and on which a crank element is provided, and a stroke ring, rotatably supported on the crank element without rotating in the housing, the stroke ring having a slide bearing face oriented toward the piston, on which face the piston is supported with a slide face, so that the piston can be acted upon by the drive shaft, a relief chamber (22), formed by a recess in the region of the slide face (16) and the slide bearing face (17), communicates with the work chamber (25), the crank element (19) together with the stroke ring (18) and portions of the piston (12) that protrude from a piston guide (13) and supported on the piston guide are disposed in a low-pressure chamber (33) in the housing (10), said low-pressure chamber (33) acts as a delivery chamber for a medium to be fed fuel; that the piston (12) has a conduit (24) that discharges into the work chamber (25); and that the conduit (24) communicates with the low-pressure chamber (33) via a suction valve (34, 35; 42) which is formed by a suction opening (34) in a wall of the piston (12), which opening cooperates with an edge (35), acting as a control edge, of the piston guide (13).

2. A reciprocating pump in accordance with claim 1, in which both the conduit (24) in the piston (12) and the relief chamber (22) each communicate via a respective suction valve (34, 35; 42, respectively) with the low-pressure chamber (33).

3. A reciprocating pump in accordance with claim 1, in which the piston (12) is received with a support face (51) of crowned portion form on an end portion (50) that protrude from a piston guide (13) in a complementary recess (52) in a sliding block (15'), which on a side remote from the recess (52) carries the slide face (16) associated with the piston (12), and a gap formed between the support face (51) on the piston (12) and the support face (53) on the sliding block (15') communicates with the connection (24, 23) of the work chamber (25) and relief chamber (22).

4. A reciprocating pump in accordance with claim 3, in which a spring (21) is supported on the piston (12).

5. A reciprocating pump in accordance with claim 1, in which a spring (21) is supported on a sliding block (15) mounted on the piston (12), said block, on a side remote from the piston (12), carries the slide face (16) associated with the piston (12).

6. A high-pressure reciprocating pump for a fuel injection system of an internal combustion engine, comprising, at least one piston, which is displaceable supported in a housing and defines a work chamber therein, a drive shaft, supported in the housing and on which a crank element is provided, and a stroke ring, rotatably supported on the crank element without rotating in the housing, the stroke ring having a slide bearing face oriented toward the piston, on which face the piston is supported with a slide face, so that the piston can be acted upon by the drive shaft, a relief chamber (22), formed by a recess in the region of the slide face (16) and the slide bearing face (17), communicates with the work chamber (25), the crank element (19) together with the stroke ring (18) and portions of the piston (12) that protrude from a piston guide (13) and supported on the piston guide are disposed in a low-pressure chamber (33) in the housing (10), said low-pressure chamber (33) acts as a delivery chamber for a medium to be fed fuel; that the piston (12) has a conduit (24) that discharges into the work chamber (25); and that the conduit (24) in the piston (12) and the relief chamber (22) each communicate via a respective suction valve (34, 35; 42, respectively) with the low-pressure chamber (33).

7. A high-pressure reciprocating pump for a fuel injection system of an internal combustion engine, comprising;

at least one piston, which is displaceably supported in a housing and defines a work chamber therein, a drive shaft, supported in the housing and on which a crank element is provided, and, a stroke ring, rotatably supported on the crank element without rotating in the housing, the stroke ring having a slide bearing face oriented toward the piston, on which face the piston is supported with a slide face, so that the piston can be acted upon by the drive shaft, a relief chamber (22), formed by a recess in the region of the slide face (16) and the slide bearing face (17), communicates with the work chamber (25), and a spring (21) supported on a sliding block (15) mounted on the piston (12) presses the piston (12) in a direction toward the stroke ring (18), and the sliding block on a side remote from the piston (12), carries the slide face (16) associated with the piston (12).

8. A reciprocating pump in accordance with claim 7, in which the relief chamber (22) is formed by a recess in the slide face (16) disposed on the piston (12) and is open toward the slide bearing face (17) on the stroke ring (18).

9. A reciprocating pump in accordance with claim 8, in which the relief chamber (22) has an effective area that is at least equal to the effective area of the piston (12).

10. A reciprocating pump in accordance with claim 8, in which the crank element (19) together with the stroke ring (18) and portions of the piston (12) that protrude from a piston guide (13) and supported on the piston guide are disposed in a low-pressure chamber (33) in the housing (10), said low-pressure chamber (33) acts as a delivery chamber for a medium to be fed fuel; that the piston (12) has a conduit (24) that discharges into the work chamber (25); and that the conduit (24) communicates with the low-pressure chamber (33) via a suction valve (34, 35; 42).

11. A reciprocating pump in accordance with claim 7, in which the relief chamber (22) has an effective area that is at least equal to the effective area of the piston (12).

12. A reciprocating pump in accordance with claim 11, in which the crank element (19) together with the stroke ring (18) and portions of the piston (12) that protrude from a piston guide (13) and supported on the piston guide are disposed in a low-pressure chamber (33) in the housing (10), said low-pressure chamber (33) acts as a delivery chamber for a medium to be fed fuel; that the piston (12) has a conduit (24) that discharges into the work chamber (25); and that the conduit (24) communicates with the low-pressure chamber (33) via a suction valve (34, 35; 42).

13. A reciprocating pump in accordance with claim 7, in which the crank element (19) together with the stroke ring (18) and portions of the piston (12) that protrude from a piston guide (13) and supported on the piston guide are disposed in a low-pressure chamber (33) in the housing (10), said low-pressure chamber (33) acts as a delivery chamber for a medium to be fed fuel; that the piston (12) has a conduit (24) that discharges into the work chamber (25); and that the conduit (24) communicates with the low-pressure chamber (33) via a suction valve (34, 35; 42).

14. A reciprocating pump in accordance with claim 13, characterized in that the relief chamber (22) communicates with the low-pressure chamber (33) via a suction bore (40) and a suction groove (43), and a suction valve (42) is disposed in the suction bore (40).

15. A reciprocating pump in accordance with claim 14, in which both the conduit (24) in the piston (12) and the relief chamber (22) each communicate via a respective suction valve (34, 35; 42, respectively) with the low-pressure chamber (33).

* * * * *